US005686678A

United States Patent [19]

Greenhoe

[11] Patent Number: 5,686,678

[45] Date of Patent: Nov. 11, 1997

[54] ROTARY SOUND PATH SELECTOR VALVE FOR MUSICAL WIND INSTRUMENTS

[76] Inventor: Gary H. Greenhoe, 4085 Lily Rd., Jackson, Wis. 53037

[21] Appl. No.: 427,248

[22] Filed: Apr. 24, 1995

[51] Int. Cl.[6] ..... G10D 9/04

[52] U.S. Cl. ..... 84/390

[58] Field of Search ..... 84/390, 393, 395, 84/388, 389, 391, 392, 394, 396

[56] References Cited

U.S. PATENT DOCUMENTS

| | | | |
|---|---|---|---|
| 2,106,281 | 1/1938 | Sattler | 84/390 |
| 4,112,806 | 9/1978 | Thayer | 84/390 |
| 4,299,156 | 11/1981 | Thayer | 84/390 |
| 4,469,002 | 9/1984 | Thayer | 84/390 |
| 5,012,714 | 5/1991 | Kongou | 84/390 |

*Primary Examiner*—Cassandra C. Spyrou
*Attorney, Agent, or Firm*—Leonard J. Kalinowski

[57] ABSTRACT

A rotary valve for a musical instrument includes a cylindrical casing having a sidewall closed at opposite ends thereof, and a rotor mounted within the casing for rotation between unoperated position, in which the main tubing is connected to a further tubing portion, and an operated position, in which a length of extension tubing is connected into the air passageway through the instrument, the rotor including a hollow shell member and rotor primary and secondary airway tubes mounted within the rotor shell member for selectively communicating input and output ports of the valve as the rotor is rotated between its unoperated and operated positions, and a plurality of vent openings in the cylindrical sidewall of the rotor shell member for providing pressure relief areas for air directed into the rotor during rotation of the rotor between its unoperated and operated positions.

22 Claims, 9 Drawing Sheets

ROTARY SOUND PATH SELECTOR VALVE FOR MUSICAL WIND INSTRUMENTS

BACKGROUND OF THE INVENTION

This invention relates to musical wind instruments, and more particularly, to a rotary valve for musical wind instruments for selecting sound paths through the instrument.

Traditionally, rotary path selector valves for musical wind instruments include a solid cylindrical rotor of a metal, such as brass and the bores cut out of the sides of the rotor are formed by machining. The diameters of the machined bores are less than the diameters of the tubes of the instrument, resulting in restriction of the sound path though the valve. It has become customary to increase the size of the bores through the rotor by expanding the bores vertically to partially compensate for restricted horizontal size. However, this results in bores which have an oval or elliptical cross section. A disadvantage of such machined rotors is that there is deterioration of the sound waves due to the mismatch between the ovalized air pathways of the rotor and the circular tubes of the instrument which are circular in cross section. In addition, the restriction in the sound path through the valve resulting from machining of the rotor from a solid metal cylinder, is magnified when traditional valves are used in series or in multiples.

Another type of rotary valve for musical wind instruments is disclosed in U.S. Pat. No. 4,905,564, which was issued to Orla E. Thayer and which is entitled ROTARY SOUND PATH SELECTOR VALVE WITH BIASED ROTOR. This valve includes a conical shaped rotor which is mounted for rotation within a conical shaped casing. The valve provides a substantially axial or straight air paths through the valve, so that sound waves enter, pass through and leave the valve without substantially changing direction or being deflected off of the walls of air passageway through the rotor.

Although the conical shape for this valve enables substantially axial air flow path to be provided through the valve, the conical valve is characterized by greater wear and the wear is uneven. The conical valve includes a seal at the base and a seal at the apex of the conical valve structure. These seals are provided on flat surfaces that are perpendicular to the axis of rotation, and as a result, there is significant wear at apex end seal which is the smaller of the two bearing surfaces. Such wear results in leakage which affects tone quality. The mounting shoulder for the apex seal extends around the inlet of the rotor, defining a sharp edge of the cone that is located in the airway. Moreover, the seals wear unevenly because the end seal at the apex is smaller than the seal at the base of the conical shape and seal wear is influenced by pushing from the back bearing through a long torque axis.

Because of the large mass of the conical rotor, the valve has a slow response time and the valve rotor tends to bind due to its tapered configuration. Moreover, the conical shaped valve is cumbersome because of its size and layout, making placement in the horn difficult in a single valve horn, and even more difficult in a horn having a multiple valve arrangement. In many cases, the valve must be located in a position in which it is engaged by the neck of the user of the instrument. In the disclosed embodiment, the valve rotor is injection molded of a plastic material, which material has characteristics, such as thermal expansion, that am different from those for the metal of the instrument on which the valve is installed which can affect performance of the instrument.

SUMMARY OF THE INVENTION

The present invention provides a rotary valve for a musical instruments for selecting sound paths. In accordance with the invention, the rotary valve includes a valve rotor which is mounted in and rotatable within a cylindrical casing having a side wall enclosed at the top and bottom by top and bottom covers which mount shaft bearings for supporting the rotor shaft at opposite ends thereof. The valve rotor provides a connection between the mouthpiece and the bell of the musical instrument when the valve rotor is in an unoperated position and connects an additional length of tubing into the air way when the valve rotor is rotated to an operated position. The valve rotor is a hollow shell member having first and second air tubes therein, one of which connects a primary inlet port with a primary outlet port and the other of which connects a secondary inlet port with a secondary outlet port. The first and second air tubes provide approximately a 90° bend in the air path through the valve rotor.

In accordance with a feature of the invention, the airways though the rotary valve are circular in cross section, maintaining the traditional cylindrical shape of the instrument tubing. The circular cross section provides a smooth transition between the valve inlet port and instrument tubing both at the input and at the output of the valve.

Further in accordance with the invention, vent apertures are provided in the sidewall of the rotor and located between the inlet and outlet openings in the sidewall of the valve rotor to provide pressure relief areas for air as the valve rotor is being turned. The vent apertures allow the air to move through the rotary valve as the valve rotor is being turned, to minimize any obstruction of the air flow. In one embodiment, the vent apertures are elliptical in shape with the long axis of the vent apertures lying in a plane that extends normal to the axis of the rotor, so that the vent apertures cover the area between the adjacent ports. An additional vent aperture is provided in the lower cover of the valve rotor for communicating the interior of the valve rotor with the exterior of the rotary valve to allow venting the interior of the rotor to the valve casing when necessary. In another embodiment, the vent openings are rectangular and are longer in at least one dimension, than the length of the diameter of the inlet and outlet ports of the rotor.

Although the radial design compromises the airway, the valve according to the invention provides better distribution of forces than does a conical valve. In addition, the valve according to the invention also holds pressure better than a valve having a conical rotor and conical casing. The rotary valve provided by the present invention is a light weight unit, and presents a low mass around the tubing so as to more closely resemble an open instrument. The valve is made by brazing the airway tubes to the interior of the hollow shell member of the rotor. Alternatively, the rotary valve is produced by molding the rotor as a one piece unit by a process such as investment cast molding.

The invention consists of certain novel features and structural details hereinafter fully described, illustrated in the accompanying drawings, and particularly pointed out in the appended claims, it being understood that various changes in the details may be made without departing from the spirit, or sacrificing any of the advantages of the present invention.

DESCRIPTION OF PREFERRED EMBODIMENTS

Figure 1:
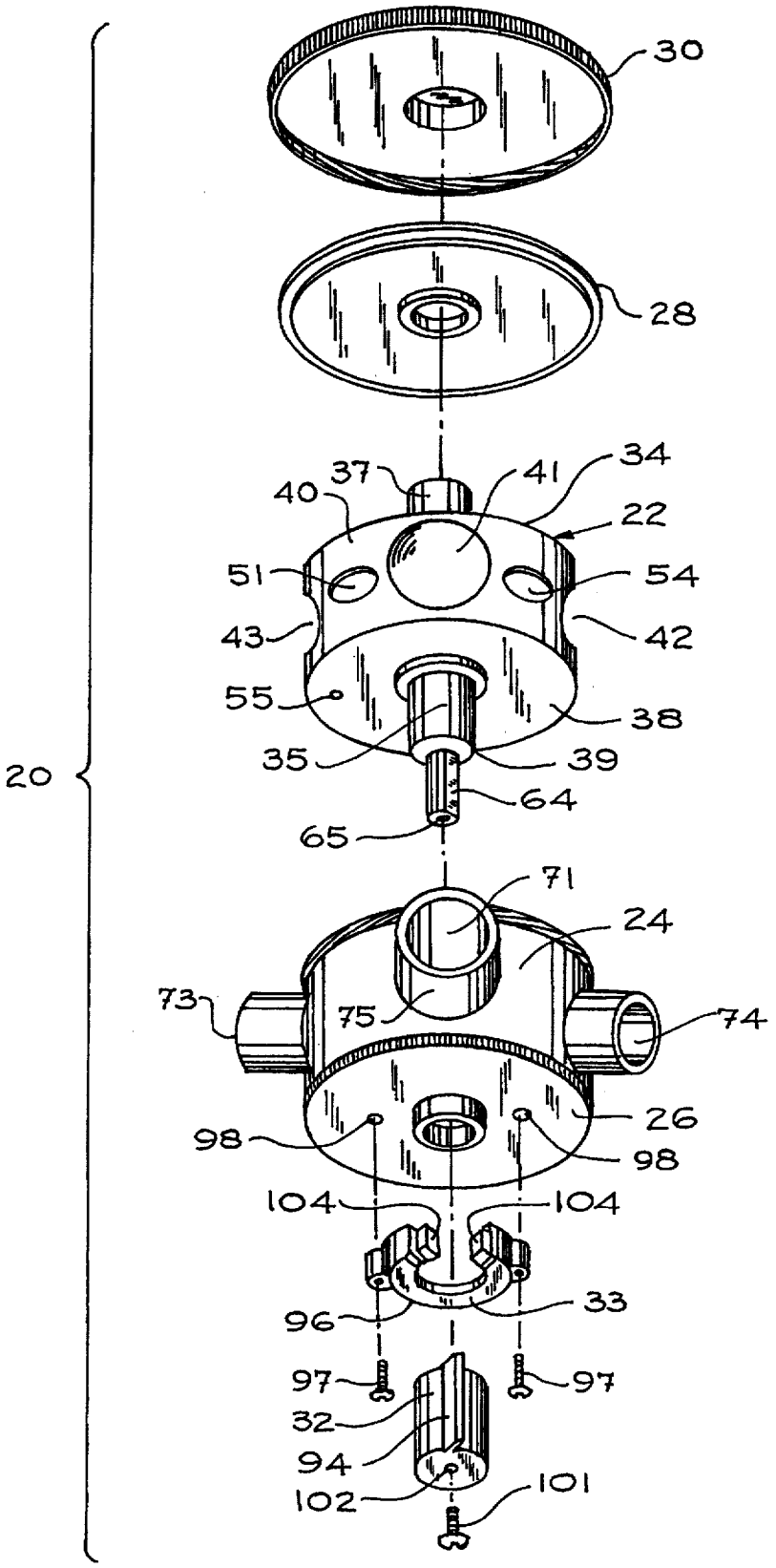
FIG. 1 is an exploded, perspective view of a rotary valve provided by the present invention.
Figure 2:
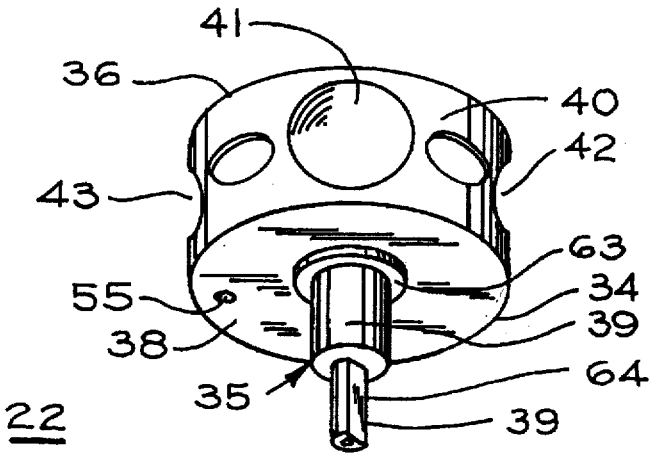
FIG. 2 is a perspective view of the rotor of the rotary valve of FIG. 1.
Figure 3:
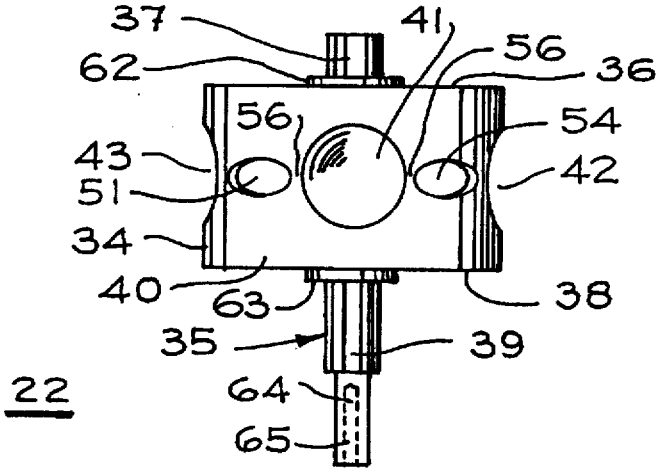
FIG. 3 is an elevation view of the rotor shown in FIG. 2.
Figure 4:
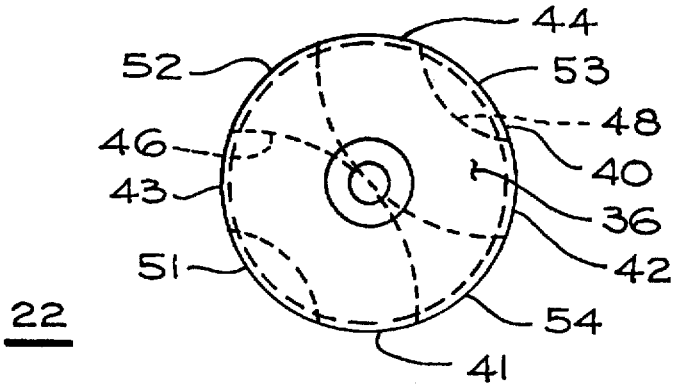
FIG. 4 is a top view of the rotor shown in FIG. 2.
Figure 5:
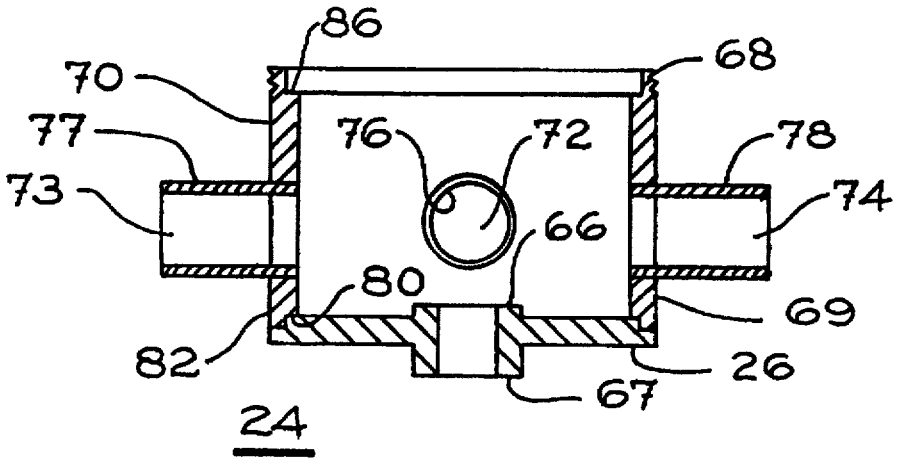
FIG. 5 is a vertical section view of the casing of the rotary valve of FIG. 1.
Figure 6:
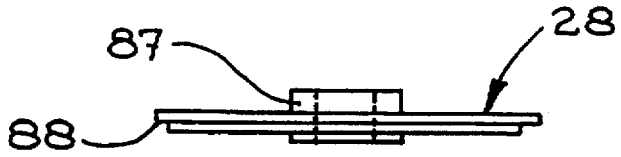
FIG. 6 is a side view of a cover plate of the rotary valve of FIG. 1.
Figure 7:
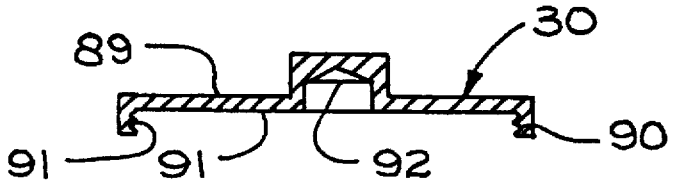
FIG. 7 is a vertical section view of an end cap of the rotor shown in FIG. 2.

Referring to the drawings, FIG. 1 is an exploded, perspective view of a rotary valve 20 provided by the present invention. The rotary valve 20 is described with reference to an application in a trombone for selecting sound paths, such as by connecting a proportioned length of tubing into the air way for changing the key or pitch of the instrument. However, the valve can be used in other types of valved wind instruments, such as rotary valve trumpets from piccolo to bass, French horns, Euphonium, Baritones, tenor tubas and tubas, for example. In addition, the valve can be used as a trill valve, as in a ½ step or whole step arrangement with interchangeable crooks.

Referring to FIGS. 1–4 and 8, the rotary valve 20 includes a rotor 22, a casing assembly including a casing 24, a bottom bearing plate 26, a cover plate 28 and an end cap 30, a stub shaft 32 and a saddle 33. The rotor 22 includes a hollow, drum-like shell member 34 and a rotor shaft 35. The shell member 34 has a top wall 36, a bottom wall 38 and a sidewall 40. The sidewall 40 tapers inward slightly from the top wall 36 to the bottom wall 38. The sidewall 40 includes a rotor primary inlet port 41, a rotor secondary inlet port 42, a rotor primary outlet port 43 and a rotor secondary outlet port 44. In the exemplary embodiment, the four rotor ports 41–44 are equally spaced along the circumference of the sidewall 40, so that each rotor port is spaced 90° from both adjacent rotor ports.

The rotor shaft 35 extends through the shell member 34 with its upper end 37 passing through an aperture (not shown) and an upper bearing 62 in the top wall 36 and its lower end 39 passing through an aperture (not shown) in a lower bearing 63 in the bottom wall 38. The upper bearing 62 and the lower bearing 63 are annular members formed on the outer surfaces of the top wall 36 and bottom wall 38. The lower end 39 of the rotor shaft 35 has a flattened section 64 which has a tapped aperture 65 extending axially of the shaft 35.

Contained within the interior of the shell member 34 are a primary airway tube 46 and a secondary airway tube 48. The airway tubes 46 and 48 are tubular segments having a gradual 90° bend. Airway tube 46 is connected to the sidewall in communication with the rotor primary ports 41 and 43 and thus, communicates, the rotor primary inlet port 41 with the rotor primary outlet port 43. Similarly, the secondary airway tube 48 is connected to the sidewall in communication with the rotor secondary ports, and thus communicates the rotor secondary inlet port 42 with the rotor secondary outlet port 44.

The inner diameter of the airway tubes 46 and 48, as well as the diameter of the rotor primary and secondary ports to which they are connected, are equal to the diameter the main bore, that is, the inner diameter of the main tubing of the instrument, so that there is a smooth transition between the valve inlet ports and instrument tubing both at the input and at the output of the rotary valve. In addition, the rotor primary and secondary ports and the airway tubes 46 and 48 are circular in cross-section, so that the traditional cylindrical shape of the instrument tubing is maintained.

Digressing, the airway tubes 46 and 48 of the rotor 22 can be discrete sections of tubing that are connected to the shell member 34 in a suitable manner, such as by brazing. In such embodiment, the top wall 36 and/or the bottom wall 38 can be produced as separate elements and secured to the sidewall 40 of the shell member 34 after the airway tubes have been installed. Alternatively, the shell member 34 and the airway tubes 46 and 48 of the rotor 22 can be produced by molding the valve rotor as a one-piece unit by a process such as investment cast molding. The elements of the rotor 22 can be made of any suitable material such as metal, ceramic, acrylic or nylon for example.

The sidewall 40 includes a plurality of vent apertures or openings, four vent openings 51–54 in the exemplary embodiment, which can be of any geometrical shape, such as circular, rectangular, triangular, elliptical, for example. The vent openings 51–54 are illustrated as being generally elliptical in shape with their long axis extending circumferentially of the sidewall. One of the vent openings 51 extends through the sidewall 40 between the rotor primary inlet port 41 and the rotor primary outlet port 43. Vent opening 52 extends through the sidewall 40 between the rotor primary outlet port 43 and the rotor secondary outlet port 44. Vent opening 53 extends through the sidewall 40 between the rotor secondary outlet port 44 and the rotor secondary inlet port 42. Vent opening 54 extends through the sidewall 40 between the rotor secondary inlet port 42 and the rotor primary inlet port 41. The bottom wall 38 includes a vent opening 55 which communicates the interior of the rotor shell member 34 with the exterior of the rotor. The elliptical shape of the vent openings 51–54 maximizes the circumferential opening through area through the rotor sidewall 40 while providing sufficient surface area for the connection of the airway tubes 46 and 48 to the rotor shell member 34.

The vent openings 51–54 are located between adjacent ports of the rotor to vent air so that air flow through the instrument, including the rotary valve, is kept continuous and minimal impedance is offered to the air flow as the valve rotor 22 is being turned to connect an additional length of tubing into the air path. The vent opening 55 provides additional pressure relief for the interior of the rotor shell member 34 and allows moisture to drain out of the interior of the drum-like shell member 34.

Referring to FIGS. 1 and 5–7, the casing 24 is a hollow cylindrical member having a sidewall 70 that is closed at its lower end by the lower bearing plate 26 and at its upper end by the cover plate 28. The sidewall 70 tapers inward slightly from its upper edge 68 to its bottom edge 69. The sidewall 70 includes a valve primary inlet port 71, a valve secondary inlet port 72, a valve primary outlet port 73 and a valve secondary outlet port 74. The valve ports 71–74 are defined by tubular port elements 75–78, respectively, which extend through apertures formed through the sidewall 70. The tubular port elements 75–78 are connected to the casing 24 in a suitable manner, such as by brazing. In the exemplary embodiment, the four valve ports 71–74 are equally spaced along the circumference of the sidewall 70, so that adjacent valve ports are spaced apart 90° from one another. The diameters of the valve primary and secondary ports correspond to the diameters of the rotor primary and secondary ports and are substantially equal to the diameter of the main bore at the point of connection of the rotary valve to the main tubing of the instrument. The valve housing including the casing 24, the bottom bearing plate 26 and the cover plate 28 and the end cap 30 can be made of metal, for example.

The bottom bearing plate 26 is a flat disc-like member that carries an inwardly directed bearing 66 for the rotor shaft and includes a raised portion 67 at its outer surface. The casing side wall 70 is countersunk at its lower edge 69 defining a mounting shoulder 80 for the bottom bearing plate 26. The bottom bearing plate can be a brazed plate or can be formed integrally with the casing 24.

The cover plate 28 is a flat disc-like member having a shoulder 88 at its peripheral edge. The center portion of the cover plate 28 extends downwardly. In addition, the top of the cover plate 28 has an upwardly projecting sleeve 87. The casing sidewall is countersunk also at its upper edge 68 defining a mounting shoulder 86 for the cover plate. The cover plate 28 is press fit into the compartment defined by the countersunk upper peripheral edge portion 68 of the casing sidewall.

The end cap 30 includes a flat disc-like portion 89 having a downwardly extending side wall 90 that has internal threads 91 that mate with the outer threads of the casing 24, enabling the end cap 30 to be screwed onto the casing 24. The end cap 30 has an inner recessed center area 92 that provides clearance for the upper end 37 of the rotor shaft 35.

Figure 8:
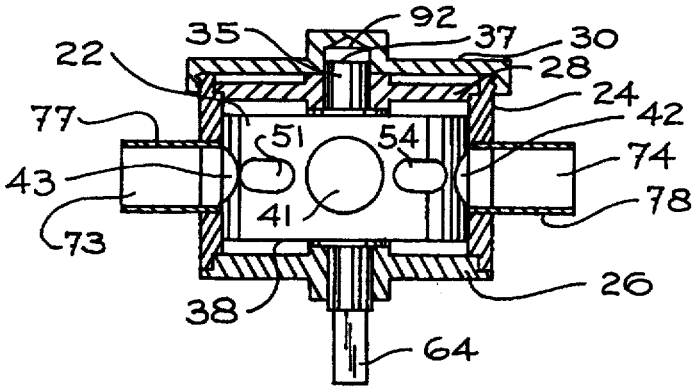
FIG. 8 is a side section view of the rotary valve provided by the present invention.

Referring to FIG. 1 and to the assembled view of the rotary valve 10 shown in FIG. 8, the lower bearing for the rotor shaft 35 includes a tapered stub shaft 32 that is press fitted onto the lower end 39 of the shaft 35. The stub shaft 32 has an axial bore complementary in shape to the lower end 39, including flattened section 64, of the rotor shaft 35. A saddle 33 is secured to bottom bearing plate by screws 97 which are received in tapped holes 98 in the bottom surface of the bottom bearing plate 28. The stub shaft 32 includes a spline 94 that cooperates with cork pads 104 and **104*a* on the saddle 33 for limiting rotational movement of the rotor 22. The spline engages pad 104 when the rotary valve is unoperated, or at rest, insuring that the rotor primary inlet and outlet are aligned with the valve primary inlet and outlet. Similarly, the spline engages pad 104*a* when the valve is operated to connect the additional section of tubing into the airway path, insuring that the rotor ports are aligned with the valve ports. The rotor shaft 35 is connected to the stub shaft 32 by a screw 101 that extends through an aperture 102 formed through the end of the stub shaft and which is received in a tapped aperture 65 in the end of the rotor shaft 35**.

When the rotor 22 is assembled in the casing 24, the lower end 39 of the rotor shaft 35 is located in the lower bearing 63 on the bottom wall or bearing plate 26 of the casing 24. The spacing between the bottom wall 38 of the rotor and the inner surface of the bottom bearing plate 26 is approximately 0.001 inch. The upper end 37 of the rotor shaft 35 is located in the recessed area 92 in the end cap 30. When the cover plate 28 is pressed into the casing 24, the rotor 22 is able to spin with a minimum of end play.

Figure 9:
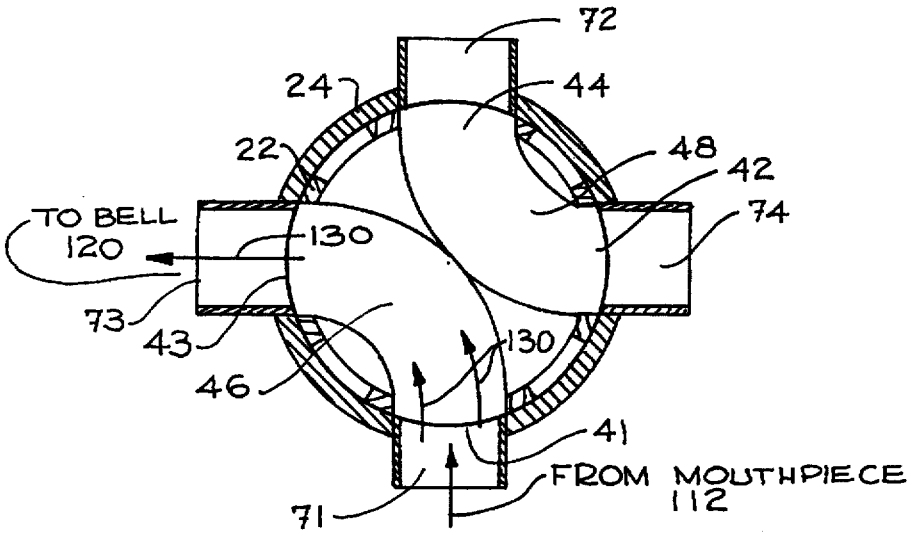
FIG. 9 is a top view of the rotary valve of FIG. 1 with the rotor shown its home position and showing the air flow path through the valve.
Figure 11:
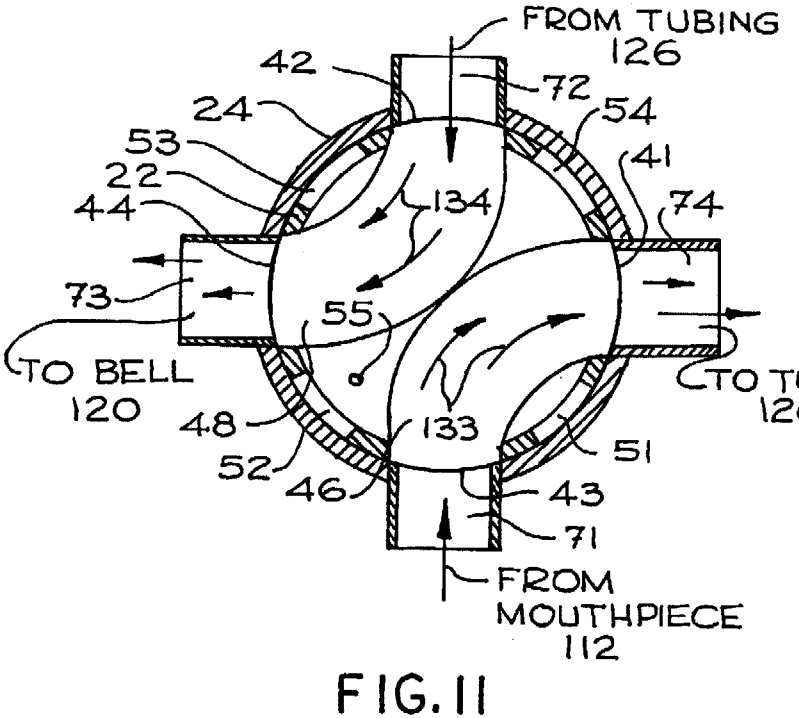
FIG. 11 is a view similar to FIG. 9 with the rotor fully rotated and showing the air flow paths through the valve.

The rotor 22 is rotatable within the casing 24 between an unoperated or rest position, shown in FIG. 9, and an operated position, shown in FIG. 11. The valve is operated by a suitable operating mechanism (not shown) such as a string linkage or a mechanical linkage that is operated by depressing a valve key as is known in the art. Such operating mechanisms are well known in the art and examples of such operating mechanisms are illustrated in U.S. Pat. No. 4,905,564, which has been referenced above. In the unoperated position (FIG. 9), the rotor primary ports 41, 43 are is in registry with the valve primary ports 71, 73, and the rotor secondary ports 42, 44 are aligned with the valve secondary ports 74, 72. In the operated position (FIG. 11), the rotor primary port 41 is in registry with the valve secondary outlet 74 and the rotor primary outlet port 43 is in registry with the valve primary inlet port 71. Also, the rotor secondary outlet port 44 is in registry with the valve primary outlet 73 and the rotor secondary inlet port 42 is in registry with the valve secondary inlet port 72.

Figure 13:
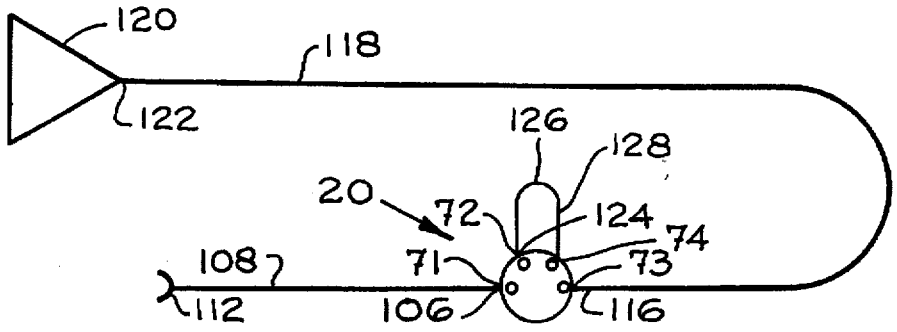
FIG. 13 is a simplified representation of a musical instrument including the rotary valve provided by the invention shown connected in series between a mouthpiece and a bell.

Referring to FIG. 13, the rotary valve 20 provided by the invention is adapted to be connected between a main tubing 108 and a further tubing portion of a musical instrument, which in the exemplary embodiment is a trombone. The valve primary inlet port 71 is connected to one end 106 of the main tubing 108, the other end of which extends from the mouthpiece 112. The valve primary outlet port 73 is connected to one end 116 of the tubing portion 118, the other end 122 of which terminates in an instrument bell 120. The valve secondary inlet port 72 is connected to one end 124 of a short section of extension tubing 126, the other end 128 of which is connected to the valve secondary outlet port 74.

Referring again to FIG. 9, when the valve rotor 22 is in the unoperated position, the valve primary inlet port 71 is communicated with the valve primary outlet port 73 by primary airway tube 46, so that a direct airway path is provided through the rotary valve 20. In this position, the only airflow passageway through the rotary valve is provided by primary airway tube 46, and air flow through the valve is in the direction of the arrows 130.

Figure 10:
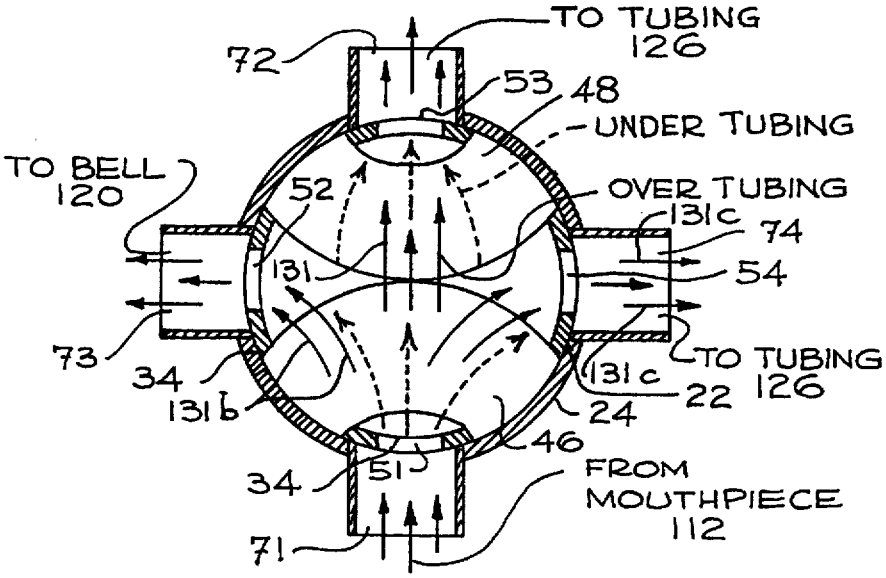
FIG. 10 is a view similar to FIG. 9 with the rotor rotated to a position midway between its home and its fully rotated positions and showing the air flow paths through the valve.
Figure 12:
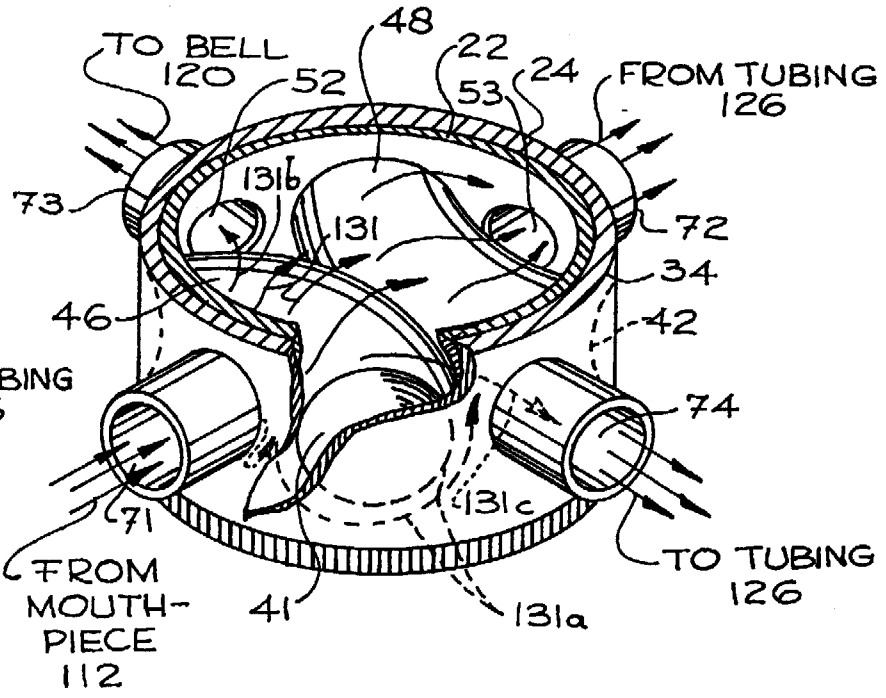
FIG. 12 is a perspective view of the rotary valve with the rotor rotated to a position midway between its home and its fully rotated positions and showing the air flow path through the vent apertures.

Referring now to FIG. 10 in conjunction with FIG. 13, when the rotary valve 20 is operated to connect the additional section of extension tubing 126 into the airway path, the valve rotor 22 is rotated (counter-clockwise in FIG. 10)

from the unoperated position towards the operated position, shown in FIG. 11, which is reached with 90° of rotation of the valve rotor. As the valve rotor 22 is being rotated, the rotor traverses positions in which the rotor inlet and outlet ports am moved out of registry with the valve inlet and outlet ports 71–74. For example, FIGS. 10 and 12 illustrate a valve rotor position which is intermediate the unoperated and operated positions for the valve, and by way of example, is shown rotated approximately 45° from its unoperated position. In this intermediate position, neither one of the rotor primary ports 41 and 43 is in registry with the valve inlet port 71. However, the vent openings 51–54 maintain air flow continuous as the valve is rotating from its unoperated to its operated position. When the rotor 22 is in this intermediate position, air supplied to the valve primary inlet port 71 from the mouthpiece flows into the hollow rotor casing 34 through the vent opening 51, over the primary airway tube 46 in the direction of the arrows 131 and under the primary airway tube 46 in the direction of the arrows 131 a, and out of the rotor casing through vent opening 53 and out of the valve through valve port 72. Also, a portion of the air flowing in through vent opening 51 flows over and under the primary airway tube 46 in the direction of the arrows 131*b* and out through vent opening 52 and valve port 73. A further portion flows over and under the primary airway tube 46 in the direction of the arrows 131*c* and out through vent opening 54 and valve port 74.

The oval or elliptical shape for the vent openings 51–54 minimizes the thickness of the rotor casing at sidewall portions 56 (FIG. 3) between the vent openings and the rotor inlet and outlet ports so that none of the valve inlet or outlet ports is ever blocked completely by the sidewall of the rotor casing, and only minimal partial blockage of the valve ports can occur. Consequently, air flow through the instrument, including the rotary valve, is kept continuous and minimal impedance is offered to the air flow as the valve rotor 22 is being turned to connect an additional length of tubing into the air path. However, the surface area around each inlet and outlet port of the rotor is sufficiently large as to promote a good seal between the rotor shell member 34 and the valve casing 24.

The vent hole 55 (FIG. 11) provides a pressure relief for the interior of the rotor shell member 34 when the vent openings 51–54 are partially blocked by the sidewall of the casing 24 as the rotor is being turned. That is, with continued rotation of the valve rotor 22 to the fully operated position, the rotor primary outlet port 43 is brought into registry with the valve primary inlet port 71 and the rotor primary inlet port 41 is aligned with the valve secondary outlet port 74, as shown in FIG. 11, so that the valve primary inlet port 71 is communicated with the valve secondary outlet port 74, and thus the input portion of the extension tubing 126, by primary airway tube 46. In addition, the rotor secondary inlet port 42 is in registry with the valve secondary inlet port 72, and the rotor secondary outlet port 44 is in registry with the valve primary outlet port 73, so that the valve secondary inlet port 72, and thus the output end of the extension tubing 126 (FIG. 13), is communicated with the valve primary outlet port 73 by the secondary airway tube 48. In the operated position, air supplied to the valve primary inlet port 71 from the mouthpiece flows into the valve and through the primary airway tube 46 in the direction of the arrows 133, out to the extension tube section 126, back into the valve through the valve secondary inlet port 72, through the secondary airway tube 48 in the direction of the arrows 134 and out to the bell 120 through the tube 118.

As the rotor 22 is approaching the operated position, the rotor inlet and output ports are being moved into registry with the valve inlet and outlet ports, the vent openings 51–54 openings become blocked by the side wall of the valve casing. The vent hole 55 in the bottom end wall 38 of the shell member 34 ensures equalization of the pressure inside the drum-like shell member 34 with the air pressure outside of the shell member 34.

The airways through the rotary valve 20 have a circular cross section, maintaining the traditional cylindrical shape of the tubing of the instrument. In addition, the airways through the rotary valve are of the same diameter as the instrument tubing so that the there is smooth transition between the valve port and instrument tubing both at the input and output of the rotary valve. The valve rotor 22 is turned in the direction of air flow when switching from its unoperated position to its operated position. That is, there is positive rotation in the direction of air flow through the rotary valve. The valve rotor returns to the unoperated position when the user releases the valve key in the manner known in the art. The vent openings 51–55 in the valve rotor 22 provide pressure relief areas for air directed into the valve rotor as the rotor is turned from its unoperated position to its operated position. The vent openings keep air moving as the valve rotor is being turned, to minimize any obstruction of the air flow. Because of the elliptical shape of the vent openings 51–54, an air path is provided over substantially the entire circumferential length of the valve rotor. Additionally, during the portion of the rotor rotation for which the rotor is intermediate its unoperated and operated positions, the vent aperture 55 in the lower plate 38 of the valve rotor communicates the interior of the rotor shell member 40 with the interior of the rotary valve casing 24.

Figure 14:
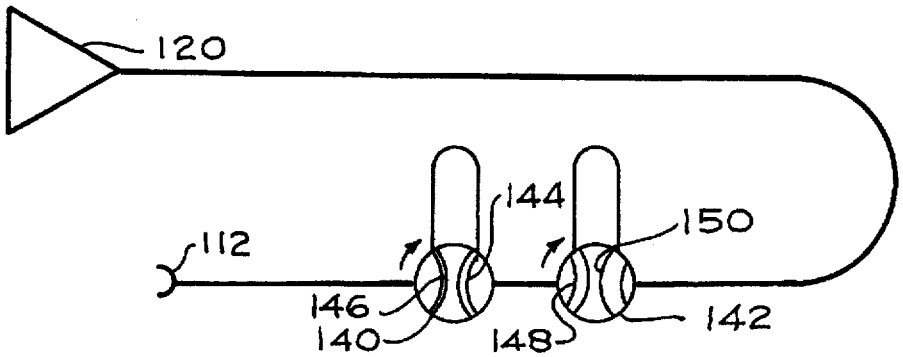
FIG. 14 is a simplified representation of a musical instrument including dual rotary valves having different bores.
Figure 15:
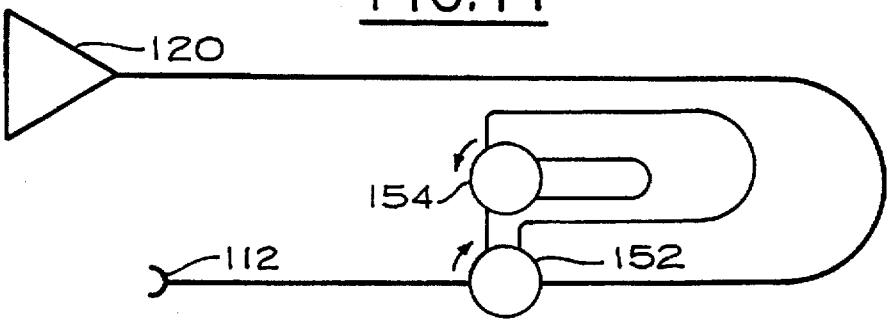
FIG. 15 is a simplified representation of a musical instrument including dependent dual rotary valves.
Figure 16:
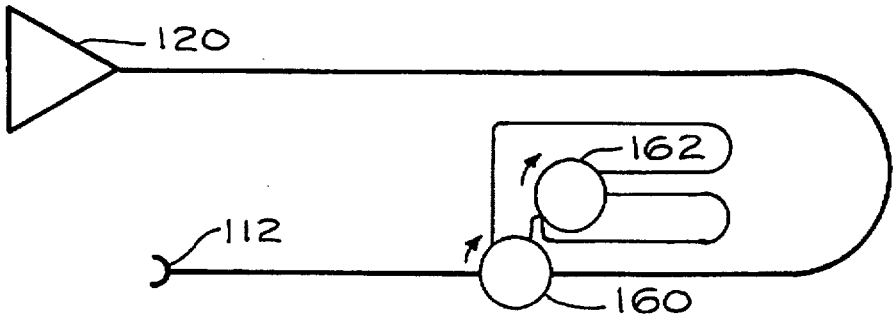
FIG. 16 is a simplified representation of a musical instrument including dependent dual rotary valves.
Figure 17:
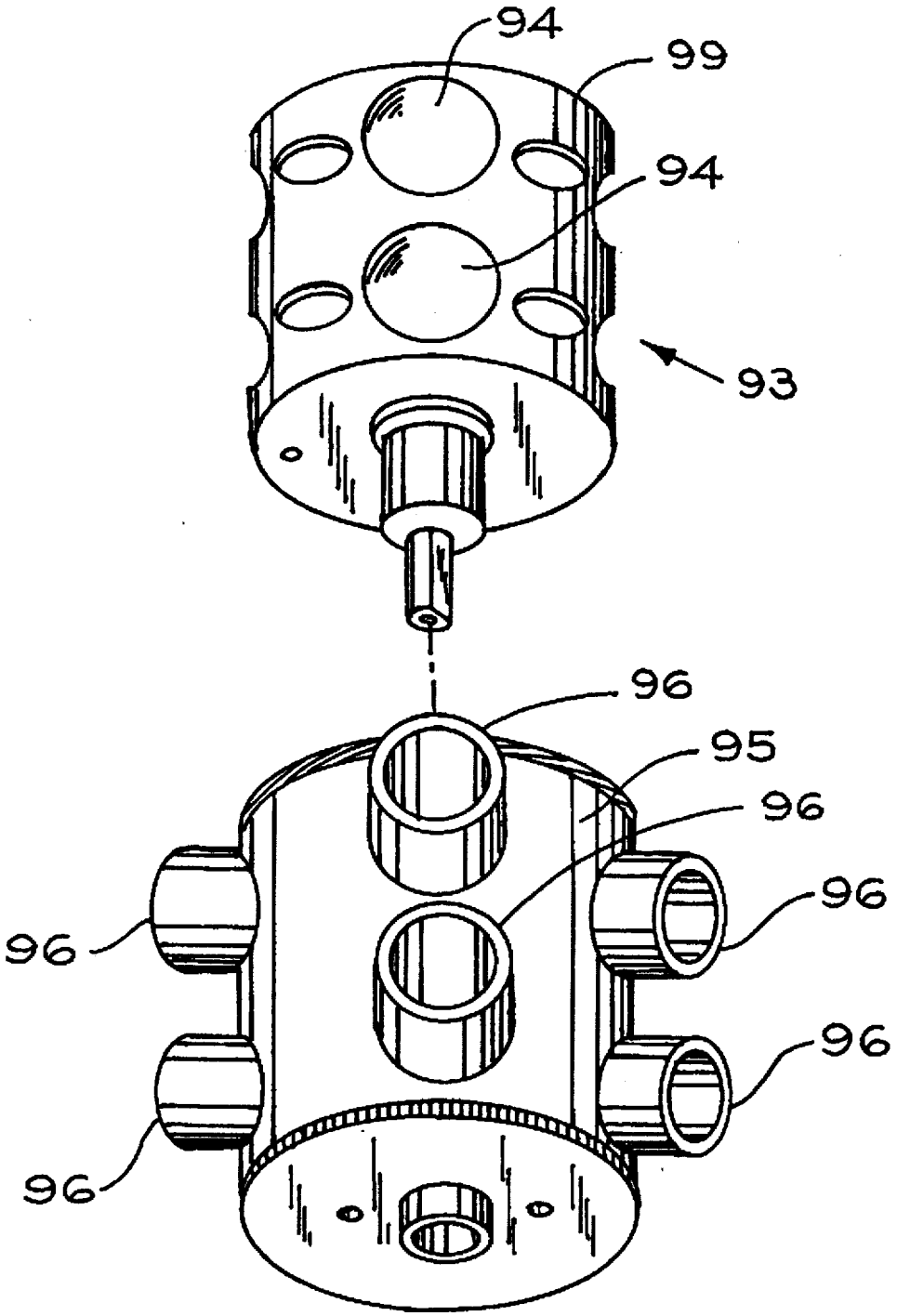
FIG. 17 is a partially exploded perspective view of a stacked rotary valve provided by the present invention.
Figure 18:
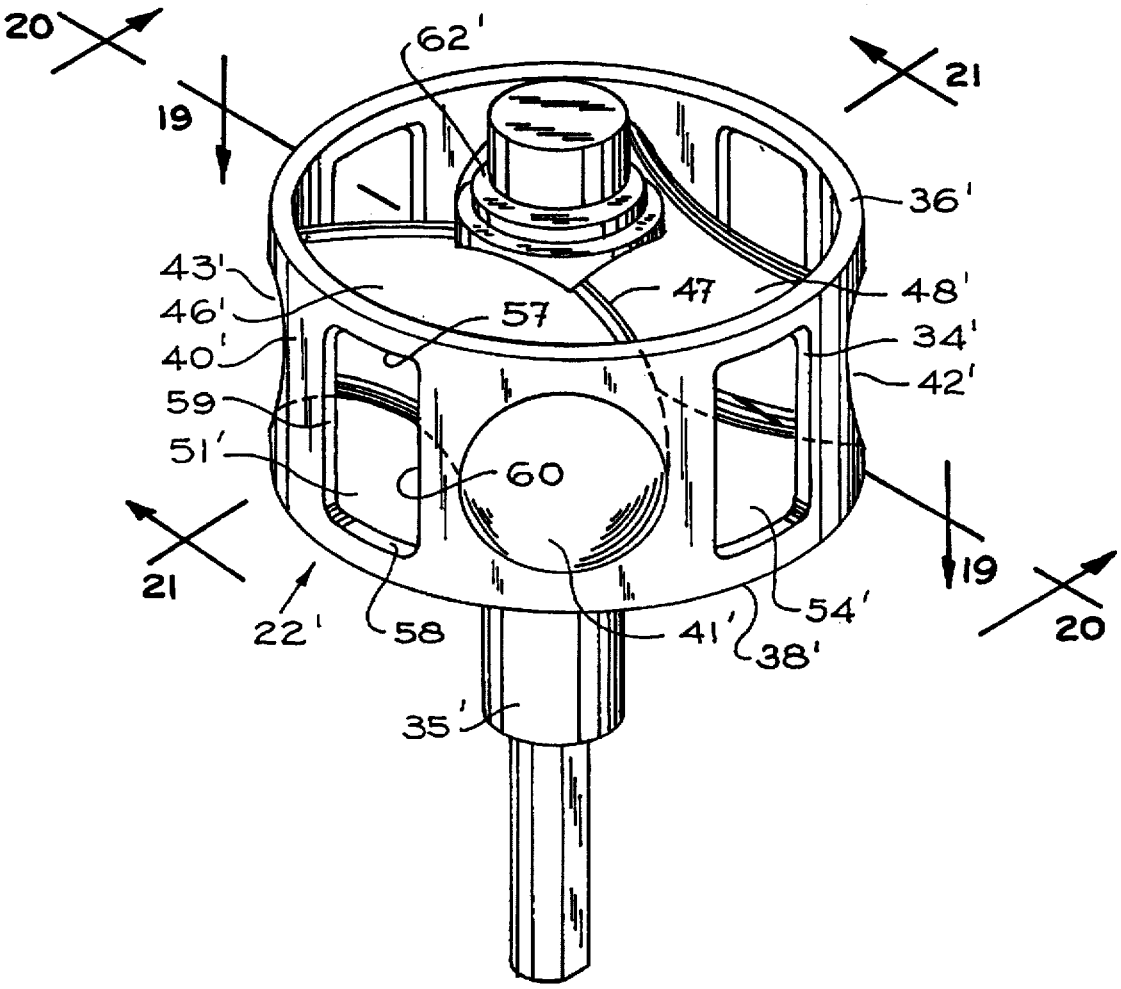
FIG. 18 is a perspective view of a further embodiment of a rotor for the rotary valve of FIG. 1.
Figure 19:
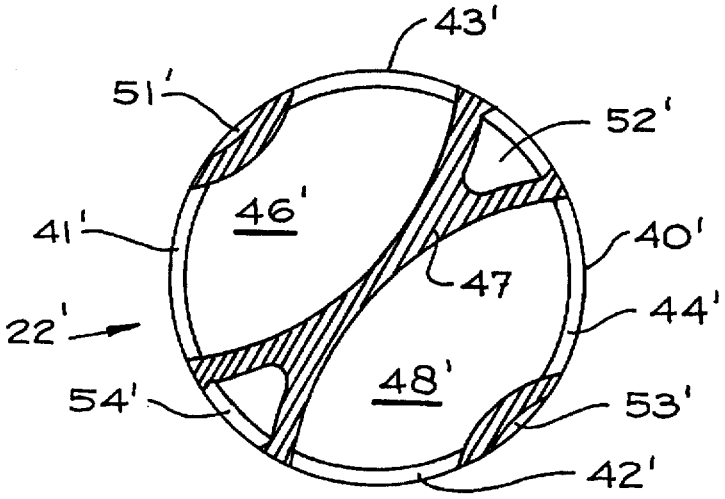
FIG. 19 is a transverse section view taken along the line 19—19 FIG. 18.
Figure 20:
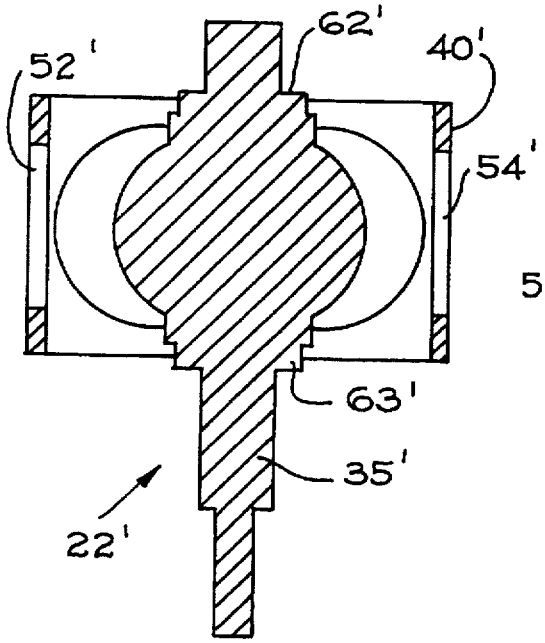
FIG. 20 is a vertical section view taken along the line 20—20 of FIG. 18.
Figure 21:
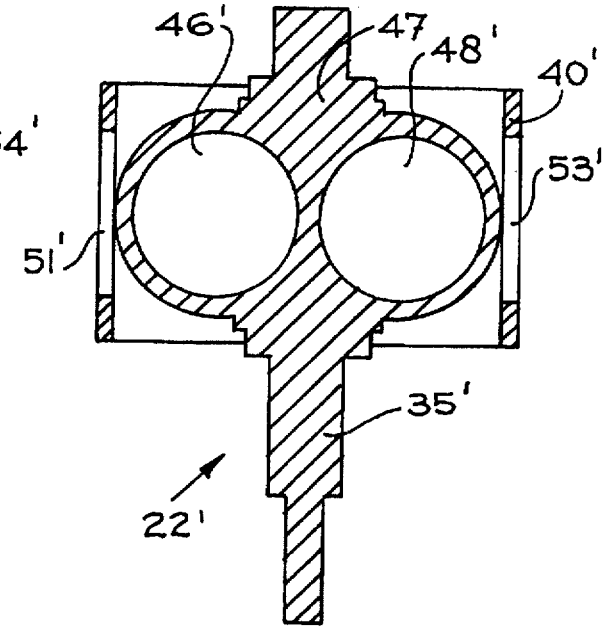
FIG. 21 is a vertical section view taken along the line 21—21 of FIG. 18.

The rotary valve according to the invention can be used as a single rotary valve 20 as shown in FIG. 13, or in combination with another like rotary valve providing a dual rotary valve arrangement as shown in FIGS. 14–16. Moreover, the rotary valve can be constructed in a stacked valve configuration, shown in FIG. 17, wherein the valve rotor 93 includes upper and lower rotor airway tubes 94 and the valve casing 95 includes corresponding upper and lower tubular ports 96. The rotor includes a hollow drum-like shell member 99 with the airway tubes 94 mounted therein in the manner of rotor 22. The stacked rotary valve formed by rotor 93 and casing 95 operates in the manner of the rotary valve of FIGS. 1–12, but providing two switchable air pathways in the manner of conventional stacked rotary valves.

FIG. 14 is a simplified representation of a musical instrument including dual rotary valves 140 and 142, each being like rotary valve 20 shown in FIGS. 1–12. The rotary valves 140 and 142 are connected in series between the mouthpiece 112 and the bell 120 of the instrument. The rotary valves 140 and 142 can have different bores and each valve can have different inlet and outlet bore sizes. Therefore, in the rotary valves 140 and 142 illustrated in FIG. 14, the bore of the outlet port 144 of valve 140 is larger than the bore of the inlet port 146. In addition, the bore of the inlet port 148 of valve 142 is greater than the bore of the outlet port 144 of valve 140 and the bore of the outlet port 150 of valve 142 is greater yet. In the arrangement illustrated in FIG. 14, the rotary valves 140 and 142 are arranged in-line, permitting independent operation.

Referring to FIG. 15, in accordance with another arrangement, dual rotary valves 152 and 154, which are like rotary valve 20, are arranged in side-by-side relationship, providing dependent operation of the rotary valves. The rotary valves 152 and 154 can have different bores and each rotary valve can have different inlet and outlet bore sizes as shown in FIG. 14.

Referring to FIG. 16, in yet another arrangement, the dual rotary valves 152 and 154 are arranged in series relationship, providing dependent operation. Again, the rotary valves 152 and 154 can have different bores and each valve can have different inlet and outlet bore sizes.

Referring now to FIGS. 18–21, there is illustrated a further embodiment for a rotor 22' which can be substituted for the rotor 22 in rotary valve 20 (FIG. 1). The rotor 22' is similar to rotor 22, and accordingly, like or similar elements have been given the same reference numeral with a prime notation. Preferably, the rotor 22' is produced as a one-piece member in a suitable manner, such as by molding using an investment casting process.

The rotor 22' includes a hollow shell member 34' having a sidewall 40' and a rotor shaft 35'. The sidewall 40' tapers inward slightly from end 36' to end 38'. The shell member 34' is open at opposite ends 36' and 38'. However, in use, the rotor 22' is enclosed within the valve casing 24 (FIGS. 1 and 8) and the bottom bearing plate 26 and the press fit cover plate 26 provide closure for the rotor 22'.

The sidewall 40' includes a rotor primary inlet port 41', a rotor secondary inlet port 42', a rotor primary outlet port 43' and a rotor secondary outlet port 44'. The rotor ports are equally spaced along the circumference of the sidewall 40', so that each rotor port is spaced 90° from its adjacent rotor ports.

Contained within the shell member 34' are a primary airway tube 46' and a secondary airway tube 48' which are tubular segments having a gradual 90° bend. The rotor primary airway tube 46' communicates the rotor primary inlet port 41' with the rotor primary outlet port 43'. Similarly, the rotor secondary airway tube 48' communicates the rotor secondary inlet port 42' with the rotor secondary outlet port 44'. The primary and secondary airway tubes have a common wall 47.

The shell member 34' includes vent openings 51'–54' formed through the sidewall 40' between adjacent rotor ports. The vent openings are illustrated as being rectangular, but the vent openings can be of other geometrical shape, such as circular, square, triangular, elliptical, for example. Each vent opening, such as vent opening 51', has opposing parallel edges 57 and 58 located near respective ends and 38' of the shell member 34' and opposing parallel edges 59 and 60 which extend perpendicular to edges 57 and 58. The length "a" between edges 57 and 58 is slightly greater, such as by ⅛ inch, than the diameter of the rotor ports, so that the vent openings are longer between its ends 36' and 36' to enable free or open air flow through the vent openings 51'–54 whenever air is being supplied to the valve as the rotor is being turned. The surface area around each inlet and outlet port of the rotor is sufficiently large as to promote a good seal between the rotor shell member 34' and the valve casing 24. The area 56' can be approximately the same as or slightly less than area 56 of rotor 22. Also, opposing edges 59 and 60, rather than being straight edges, can have arcuate or triangular shaped cutouts to minimize the area between the vent openings and the rotor inlet ports and outlet ports.

The rotor shaft 35' is formed integrally with the common wall portion of the airway tubes and includes a bearing 62' formed integrally with the shaft 35' near one end 37' and a bearing 63' formed integrally with the shaft 35' near its opposite end 39'. The end 39' of the rotor shaft 35' has a flattened section 64' with a tapped aperture extending axially of the shaft 35' in the manner of shaft 35.

In use, the rotor 22' is mounted in the valve casing 24 (FIG. 1) in the manner of rotor 22. The manner in which the valve including the rotor 22' operates is the same as when the valve includes rotor 22, except more free flow is provided through the vent openings because the dimension of the vent openings 51'–54' between opposing edges 57 and 58 is slightly larger than the diameter of the rotor airway tubes.

While the invention has been described with reference to preferred embodiments, various modifications can be made without departing from the spirit and scope of the invention as defined in the appended claims.

I claim:

1. A rotary valve for a musical instrument including a main tubing with a mouthpiece at one end thereof, a further tubing portion terminating in an instrument bell, and at least one length of extension tubing, the musical instrument including an operating mechanism for operating the rotary valve, said rotary valve comprising:

a cylindrical casing having a sidewall closed at opposite ends thereof, said sidewall defining a plurality of valve ports, said main tubing and said further tubing portion being connected to first and second ones of said valve ports, respectively, and said length of extension tubing being connected to third and fourth ones of said valve ports;

a rotor located within said casing, said rotor being adapted to be coupled to said operating mechanism for rotation thereby between first and second positions, said rotor including a hollow shell member having a cylindrical sidewall, said sidewall having a plurality of openings therethrough defining first and second rotor inlets and first and second rotor outlets, a primary airway tube within said shell member, said primary airway tube including a first tubular segment connected to said sidewall in communication with said first rotor inlet and said first rotor outlet for communicating said first rotor inlet with said first rotor outlet, said first rotor inlet being in registry with said first valve port and said first rotor outlet being in communication with said second valve port when said rotor is in said first position, said first rotor inlet being in registry with said third valve port and said first rotor outlet being in registry with said first valve port when said rotor is in said second position, and said rotor including a secondary airway tube within said shell member, said secondary airway tube including a second tubular segment connected to said sidewall in communication with said second rotor inlet and said second rotor outlet for communicating said second rotor inlet with said second rotor outlet, said second rotor inlet being in registry with said fourth valve port and said second rotor outlet being in registry with said second valve port when said rotor is in said second position, said rotor including at least first and second vent openings through said sidewall of said shell member, said first vent opening being located between said first rotor inlet and said first rotor outlet and said second vent opening being located opposite said first vent opening for providing pressure relief areas for air directed into said rotor as said rotor is being rotated between said first and second positions, whereby air flow through the instrument, including said rotary valve, is maintained substantially continuous and minimal impedance is offered to air flow through the instrument during rotation of said rotor.

2. The rotary valve according to claim 1, wherein said first rotor inlet and said first rotor outlet are spaced apart from one another approximately 90° along the circumference of said shell member and said first tubular segment has a gradual, approximately 90° bend, and wherein said second rotor inlet and said second rotor outlet are spaced apart from one another approximately 90° along the circumference of said shell member and said second tubular segment has a gradual, approximately 90° bend.

3. The rotary valve according to claim 1, wherein said airway tubes are brazed to said sidewall of said shell member.

4. The rotary valve according to claim 1, wherein said airway tubes are molded integrally with said sidewall of said shell member.

5. The rotary valve according to claim 1, wherein the inner diameter of said primary and secondary airway tubes is substantially equal to the inner diameter of the main tubing of the instrument.

6. A rotary valve for a musical instrument including a main tubing with a mouthpiece at one end thereof, a further tubing portion terminating in an instrument bell, and at least one length of extension tubing, the musical instrument including an operating mechanism for operating the rotary valve, said rotary valve comprising:

a cylindrical casing having a sidewall closed at opposite ends thereof, said sidewall defining a plurality of valve ports, said main tubing and said further tubing portion being connected to first canned second ones of said valve ports, respectively, and said length of extension tubing being connected to third and fourth ones of said valve ports;

a rotor located within said casing, said rotor being adapted to be coupled to said operating mechanism for rotation thereby between first and second positions, said rotor including a hollow shell member having a cylindrical sidewall, said sidewall having a plurality of openings therethrough defining first and second rotor inlets and first and second rotor outlets, a primary airway tube within said shell member, said primary airway tube including a first tubular segment connected to said sidewall in communication with said first rotor inlet and said first rotor outlet for communicating said first rotor inlet with said first rotor outlet, said first rotor inlet being in registry with said first valve port and said first rotor outlet being in communication with said second valve port when said rotor is in said first position, said first rotor inlet being in registry with said third valve port and said first rotor outlet being in registry with said first valve port when said rotor is in said second position, and said rotor including a secondary airway tube within said shell member, said secondary airway tube including a second tubular segment connected to said sidewall in communication with said second rotor inlet and said second rotor outlet for communicating said second rotor inlet with said second rotor outlet, said second rotor inlet being in registry with said fourth valve port and said second rotor outlet being in registry with said second valve port when said rotor is in said second position, said sidewall of said shell member including a plurality of vent openings therethrough, whereby air flow through the instrument, including said rotary valve, is maintained substantially continuous and minimal impedance is offered to air flow through the instrument during rotation of said rotor.

7. The rotary valve according to claim 6, wherein said vent openings are generally elliptical in shape.

8. The rotary valve according to claim 6, wherein said vent openings are generally rectangular in shape.

9. The rotary valve according to claim 6, wherein said sidewall of said shell member includes four vent openings which are spaced apart equidistantly around the periphery of said sidewall of said shell member.

10. The rotary valve according to claim 6, wherein said rotor includes first and second end members closing said shell member at opposite ends thereof, and wherein at least one of said end members has at least one vent aperture therethrough.

11. A rotary valve for a musical instrument including a main tubing with a mouthpiece at one end thereof, a further tubing portion terminating in an instrument bell, and at least one length of extension tubing, the musical instrument including an operating mechanism for operating the rotary valve, said rotary valve comprising:

a cylindrical casing having a sidewall closed at opposite ends thereof, said sidewall defining a plurality of valve ports, said main tubing and said further tubing portion being connected to first and second ones of said valve ports, respectively, and said length of extension tubing being connected to third and fourth ones of said valve ports;

a rotor located within said casing, said rotor being adapted to be coupled to said operating mechanism for rotation thereby between first and second positions, said rotor including a hollow shell member having a cylindrical sidewall, said sidewall having a plurality of openings therethrough defining first and second rotor inlets and first and second rotor outlets, a primary airway tube within said shell member and connected to said sidewall in communication with said first rotor inlet and said first rotor outlet for communicating said first rotor inlet with said first rotor outlet, said first rotor inlet being in registry with said first valve port and said first rotor outlet being in communication with a second valve port when said rotor is in said first position, and said first rotor inlet being in registry with said third valve port and said first rotor outlet being in registry with said first valve port when said rotor is in said second position, and said rotor including a secondary airway tube within said shell member and connected to said sidewall in communication with said second rotor inlet and said second rotor outlet for communicating said second rotor inlet with said second rotor outlet, said second rotor inlet being in registry with said fourth valve port and said second rotor outlet being in registry with said second valve port when said rotor is in said second position, said rotor including at least first and second vent openings through said sidewall of said shell member, said first vent opening being located between said first rotor inlet and said first rotor outlet and said second vent opening located opposite to said first vent opening for providing pressure relief areas for air directed into said rotor as said rotor is being rotated between said first and second positions, whereby air flow through the instrument, including said rotary valve, is maintained substantially continuous and minimal impedance is offered to air flow through the instrument during rotation of said rotor.

12. The rotary valve according to claim 11, wherein said sidewall of said shell member includes third and fourth vent openings therethrough said third vent opening being located between said first rotor outlet and said second rotor outlet, said fourth vent opening being located between said first rotor inlet and said second rotor inlet.

13. The rotary valve according to claim 11, wherein said first and second vent openings are generally elliptical in shape.

14. The rotary valve according to claim 11, wherein said rotor includes first and second end members closing said shell member at opposite ends thereof, and wherein at least said second end member of said rotor has at least one vent aperture therethrough.

15. The rotary valve according to claim 11, wherein said airway tubes are molded integrally with said sidewall of said shell member.

16. The rotary valve according to claim 11, wherein said vent openings are generally rectangular in shape.

17. A rotor for a rotary valve for a musical instrument, said rotor comprising:

a hollow shell member having a sidewall and first and second end members closing said shell member at opposite ends thereof, said sidewall having a plurality of openings therethrough defining first and second rotor inlets and first and second rotor outlets spaced apart along the circumference of said shell member, a primary airway tube within said shell member for communicating said first rotor inlet with said first rotor outlet, a secondary airway tube within said shell member for communicating said second rotor inlet with said rotor second outlet, a plurality of vent openings through said sidewall of said shell member for providing pressure relief areas for air directed into said rotor as said rotor is being rotated between said first and second positions, a first one of said first vent openings being located between said first rotor inlet and said first rotor outlet, and a second one of said vent openings being located opposite to said first vent opening.

18. The rotor according to claim 17, wherein said second vent opening is located between said second inlet and outlet ports, a third one of said vent openings is located between said first and second outlet ports and a fourth one of said vent openings is located between said first and second inlet ports.

19. The rotor according to claim 17, wherein said vent openings are elliptical in shape and are spaced apart equidistantly along the periphery of said sidewall.

20. The rotor according to claim 17, wherein said airway tubes are brazed to said sidewall.

21. The rotor according to claim 17, wherein said airway tubes are molded integrally with said sidewall.

22. The rotary valve according to claim 17, wherein said vent openings are generally rectangular in shape.

* * * * *